United States Patent [19]

Chance et al.

[11] 4,442,735

[45] Apr. 17, 1984

[54] CHAMPAGNE CORK PULLER

[76] Inventors: Allan Chance, 100 Eldridge St., Mill Valley, Calif. 94941; William T. Gray, 19612 Grandview Dr., Topanga, Calif. 90290

[21] Appl. No.: 444,406

[22] Filed: Nov. 24, 1982

[51] Int. Cl.[3] ..... B67B 7/06; B65D 39/00

[52] U.S. Cl. ..... 81/3.44; 215/296; 215/272; 215/274; 81/3.1 B; 81/3.1 C; 81/3.36

[58] Field of Search ..... 215/296, 303, 226, 272–275, 215/299, 252, 213, 257; 81/3.1 B, 3.31, 3.34, 3.36, 3.38 R, 3.4, 3.44, 3.1 C

[56] References Cited

U.S. PATENT DOCUMENTS

| | | | |
|---|---|---|---|
| 193,684 | 7/1877 | Bell | 215/213 X |
| 210,545 | 12/1878 | Lindsay | 215/213 X |
| 507,669 | 10/1893 | Atwood | 215/296 X |
| 622,074 | 3/1899 | Reeder | 215/273 |
| 796,355 | 8/1905 | Recht | 215/303 |
| 1,093,768 | 4/1914 | Corkery | 81/3.44 |
| 1,219,510 | 3/1917 | Weber | 215/299 |
| 1,222,765 | 4/1917 | Hudson | 215/296 |
| 1,441,742 | 1/1923 | O'Brien | 215/272 |
| 1,871,831 | 8/1932 | Williams | 215/272 |
| 2,032,521 | 3/1936 | Barton | 215/253 X |
| 2,665,023 | 1/1954 | Mogneault | 215/274 X |
| 2,808,954 | 10/1957 | Smith | 215/275 |
| 2,961,119 | 11/1960 | Leach | 215/252 |
| 3,080,991 | 3/1963 | Fox | 215/257 |
| 3,310,191 | 3/1967 | Kern et al. | 215/252 |
| 4,067,473 | 1/1978 | Awer et al. | 215/226 |
| 4,406,182 | 9/1983 | Antone | 81/3.38 R |

FOREIGN PATENT DOCUMENTS

| | | | |
|---|---|---|---|
| 593820 | 3/1934 | Fed. Rep. of Germany | 81/3.34 |
| 2644647 | 4/1978 | Fed. Rep. of Germany | 81/3.38 |

*Primary Examiner*—Steven M. Pollard
*Assistant Examiner*—Bryon Gehman
*Attorney, Agent, or Firm*—Townsend and Townsend

[57] ABSTRACT

A safety device for preventing premature expulsion of a stopper in the ridged neck of a container for beverages under pressure, such as a champagne bottle. A body has a top and downwardly extending opposed leg portions attached to the top, each leg portion having upper and lower inner ledge portions, the upper ledge portion being positioned for engagement with the lower rim surface of the stopper, the lower edge portion being positioned to provide a limit stop with the lower surface of the neck ridge upon upward motion of the device. The leg portions can be bent outwardly at the bottom to enable attachment of the device over the stopper and the upper portion of the neck, and a collar slidably disposed on the periphery of the body retains the lower ends of the leg portions during stopper removal to ensure engagement between the lower inner edge portions and the neck ridge.

An alternate embodiment incorporates the stopper into the top as a downwardly depending centrally arranged cylinder. Another embodiment incorporates a centrally located projection depending downwardly from the top and inserted into a cork stopper.

20 Claims, 27 Drawing Figures

CHAMPAGNE CORK PULLER

BACKGROUND OF THE INVENTION

This invention relates to devices for removing stoppers from necked containers, and particularly containers used to store beverages under pressure, such as champagne.

One of the major causes of eye injury each year is errant flying corks from champagne bottles and other corked bottles having liquid contents under pressure. At serving temperature, the pressure in a champagne bottle is about ninety pounds per square inch, and a cork spontaneously ejected from a bottle after removal of the wire mesh cage attains a velocity of about forty-five feet per second when it strikes the eye. Since a cork travelling at this speed can reach the eye from a distance of two feet in less than 0.05 second, and as the blink reflex takes about 0.1 second, the cornea of the eye usually receives the full impact of the cork. The problem of eye injuries due to flying corks has been aggravated by the recent introduction of plastic stoppers.

Although there is a preferred technique for removing corks from pressurized bottles, even waiters and waitresses who presumably are instructed in the proper technique suffer eye injuries from flying corks. While safety devices have been designed in the past to provide a protective stop against unlimited motion of a cork during removal, these devices typically employ awkward lever type arrangements which are inconvenient to carry and somewhat cumbersome to use, particularly since most devices have long lever arms extending perpendicular to the axis of the bottle.

SUMMARY OF THE INVENTION

The invention comprises a safety device for assisting in the removal of stoppers from bottles whose contents are under pressure which can be fitted over the stopper and the top portion of the bottle neck, either at the bottling plant or at the opening site, which is convenient to use, and which prevents erratic motion of the stopper during removal.

In its most general aspect, the invention comprises a device for removing a stopper from a container having a ridged neck, the device including a body having a top and opposed leg portions. Each leg portion is joined at the upper end to the top, and has an upper and a lower inner ledge portion. The upper ledge portions are located along the length of the body at a distance below the top to enable the head of the stopper to be clinched between the upper ledge portion and the lower surface of the top of the device. The lower edge portion of each leg portion is located along the length of the body at a distance below the top to provide a limit stop with the ridged container neck during removal of the stopper.

In order to permit application of the device over the stopper and the upper portion of the bottle neck, it is necessary to spread the leg portions so that the inner ledges can clear the outer perimeter of the stopper and the neck ridge. This motion is afforded alternatively by forming the top portion in two parts and providing a pivot joint therebetween, by forming the top portion of a flexible material, or by forming the upper part of the leg portions near the top of a flexible material, such as plastic.

Several different embodiments of the invention are disclosed herein, some of which are provided with an additional locking feature which prevents upward motion of the device until the user is ready to remove the stopper. This additional locking feature comprises a releasable stop member providing an interference fit with the neck ridge when the bottle is in storage and which can be released prior to removal of the stopper. One embodiment comprises a locking ring having a pair of arms inserted through corresponding apertures in the body leg portions, which can be removed by pulling on the ring. An alternate embodiment comprises a pair of removable links each having a pair of inner lugs snap fitted into a pair of apertures in the associated leg portions. Still another embodiment comprises a releasable lock ring having a pair of pull-tabs enabling the ring to be manually removed. Still another embodiment comprises a plurality of upstanding spring fingers integrally molded with the body leg portions, each spring finger terminating in an upper end adjacent the neck ridge and located outboard of the neck ridge when unconstrained, together with a lock ring releasably secured to the free ends of the fingers for normally constraining the free ends in abutment with the neck ridge during storage until the ring is released. The ring preferably has a serrated inner margin with alternate lands and grooves joined by skewed side wall portions to permit the fingers to be released by simply twisting the ring.

In a modified embodiment of the basic device, the stopper is integrally formed with the top of the body to eliminate the need for a separate stopper, and the upper ledge portion is used to provide the storage locking function described above. In still another modification of the basic device, intended for use with a penetrable stopper such as a cork, a downwardly depending projection is formed centrally of the under surface of the top and is inserted into the cork during the bottling process.

For a fuller understanding of the nature and advantages of the invention, reference should be had to the ensuing detailed description taken in conjunction with the accompanying drawings.

BRIEF DESCRIPTION OF THE DRAWINGS

FIG. 14 is a partial sectional view of an alternate embodiment of the invention in which the device coacts directly with the stopper by means of a central projection.

DESCRIPTION OF THE PREFERRED EMBODIMENTS

Figure 1C:
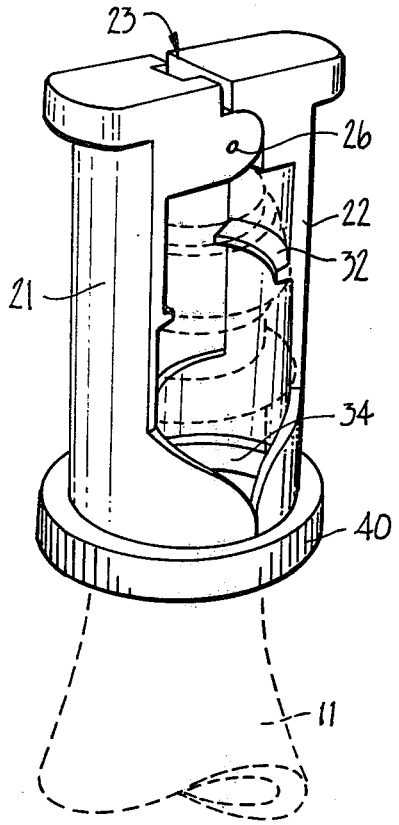
Figure 1D:
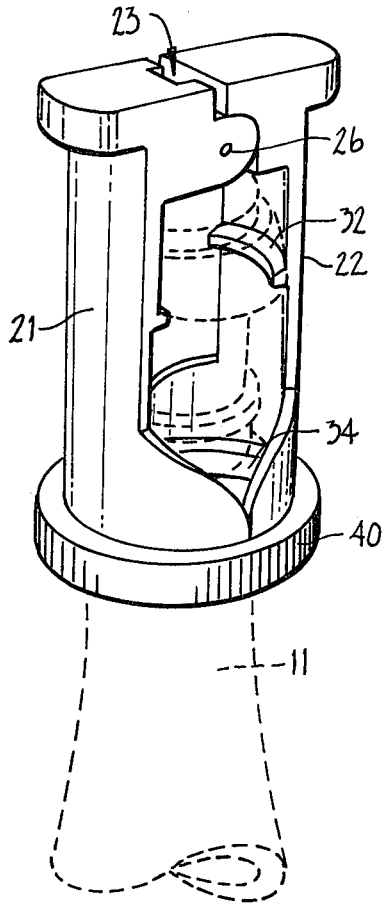
Figure 2A:
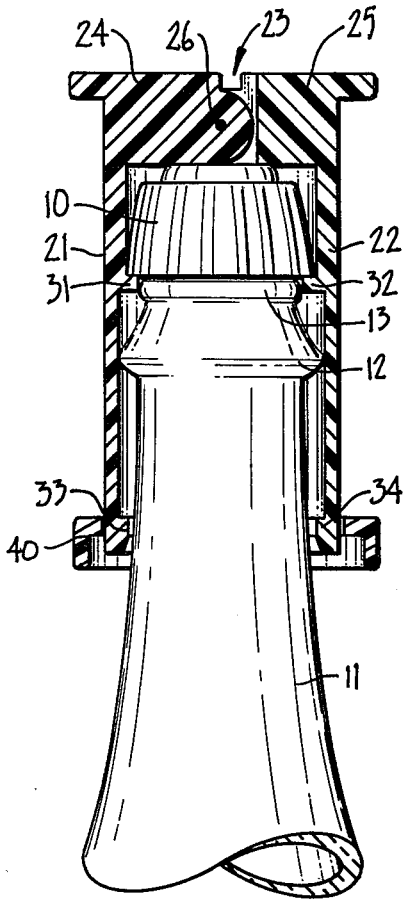
FIGS. 2A and 2B are sectional views illustrating operation of the FIG. 1 device.
Figure 2B:
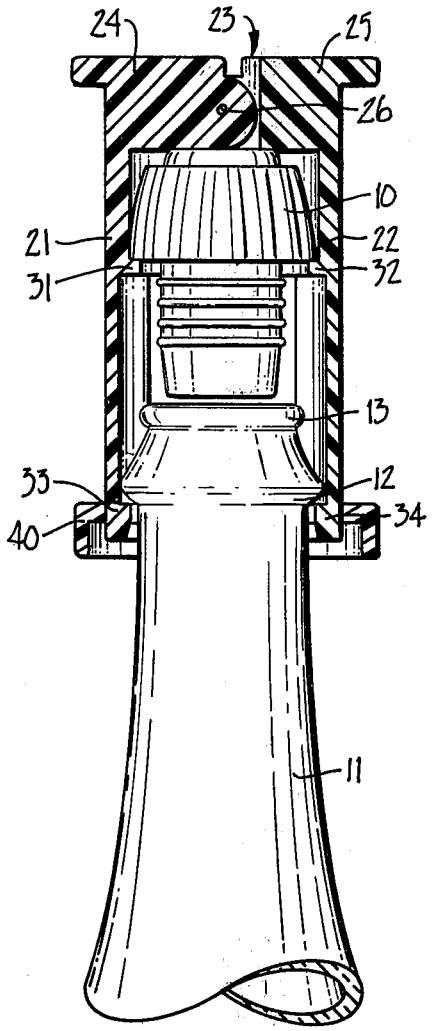

Turning now to the drawings, FIGS. 1A–1D, 2A–2B and 3A–3B illustrate a first embodiment of the invention. FIGS. 1A–1D are sequential views which illustrate use of the device in removing a stopper, such as a champagne cork 10 illustrated in broken lines and inserted into the neck 11 of a bottle having a neck ridge 12 and a lip 13. As seen in these Figs., the device comprises a body having symmetric leg portions 21, 22 terminating at the upper end in a top portion generally designated with reference numeral 23 having two half portions 24, 25 pivotally joined together by means of a pivot pin 26. As best seen in FIGS. 2A and 2B, each leg portion 21, 22 has an upper inner ledge portion 31, 32, and a lower inner ledge portion 33, 34 integrally formed therewith. The upper inner ledge portions 31, 32 are positioned along the length of leg portions 21, 22 so as to engage the lower rim surface of the cork 10 when the device is installed on the top of the bottle as best shown in FIG. 2A. The lower inner ledge portions 33, 34 are positioned along the length of leg portions 21, 22 so as to permit axial travel of the stopper 10 to the position illustrated in FIG. 2B in which the stopper is removed from the bottle neck. At this point, lower inner ledge portions 33, 34 abut the lower surface of the neck ridge 12 and provide a limit stop in the direction of removal. It should be noted that lower inner ledge portions 33, 34 can be positioned slightly higher than the position illustrated in the Figs., if desired, so that the lower tip of cork 10 is not completely free of the bottle neck, but is loose enough to enable the gas pressure to be released from the inside of the bottle.

An annular collar 40 is slidably received about the outer periphery of the leg portions 21, 22 and has a lower flange 41 with a pair of oppositely arranged relieved regions 42, 43 for enabling the collar to be manipulated downwardly over outwardly extending lugs 46–49 formed at the bottom of leg portions 21, 22 in order to lock the leg portions 21, 22 in the position illustrated in FIGS. 2A and 2B, so that the lower inner edge portions 33, 34 cannot slip past the neck ridge 12 during removal of the stopper 10.

Figure 1A:
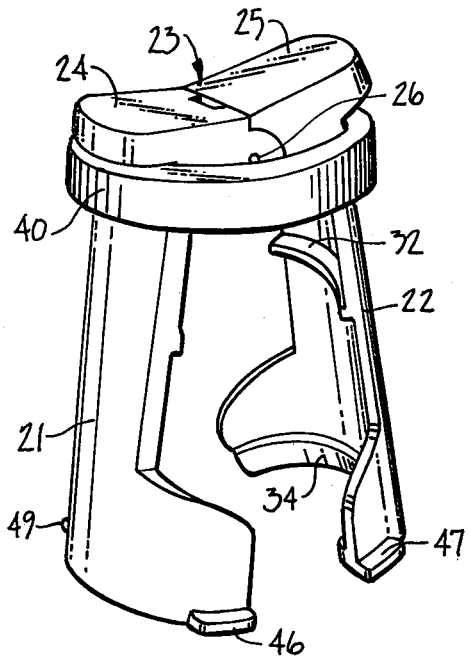
FIGS. 1A–1D are sequential perspective views of a first embodiment of the invention illustrating use of the invention to remove a stopper.
Figure 1A:
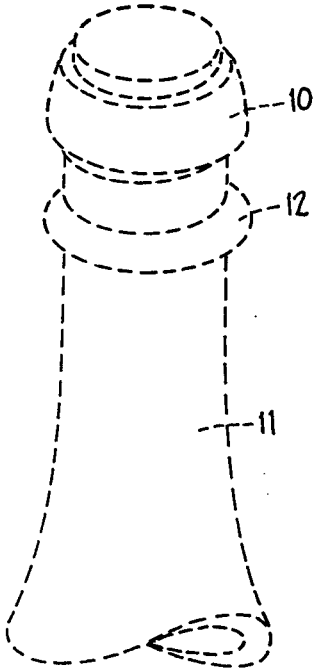
Figure 1B:
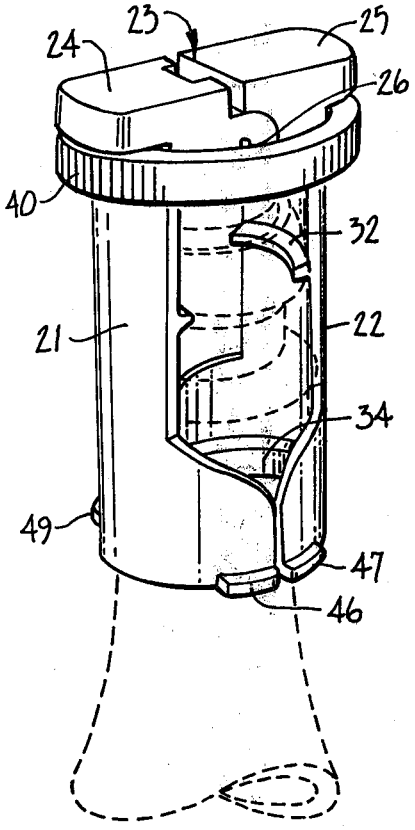
Figure 3A:
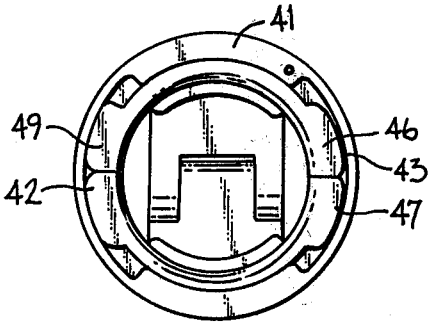
FIGS. 3A and 3B are bottom views of the FIG. 1 device illustrating alternate positions of the restraining collar.
Figure 3B:
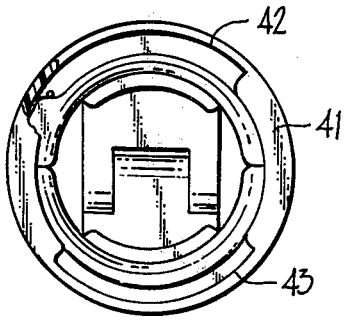

The device is operated in the following manner. With collar 40 in the upper position illustrated in FIG. 1A, the leg portions 21, 22 are spread and the device is lowered onto the stopper 10 and neck 11 until the top surface of the stopper 10 abuts the lower surface of top 23, after which leg portions 21, 22 are manipulated to the closed position illustrated in FIG. 1B. Collar 40 is manipulated downwardly until the lugs 46–49 have passed through the relieved portions 42, 43 of the lower collar flange 41 (FIG. 3A). Collar 40 is then rotated by approximately ninety degrees so that the lugs 46–49 are captured by the flange 41 (FIG. 3B). In this position, upper inner ledge portions 31, 32 engage the lower rim of stopper 10 (FIGS. 1C, 2A). The outer periphery of the device is then grasped by the user and pulled upwardly to provide a removal force for the stopper 10. During upward travel, the lower inner ledge portions 33, 34 abut the under surface of the neck ridge 12 when the stopper has been removed to the point at which the pressurized gas can be released. Since leg portions 21, 22 are constrained by collar 40, the device cannot be removed from the bottle neck until the collar 40 is rotated to the position illustrated in FIG. 3A and then manipulated upwardly to the top.

Figure 4A:
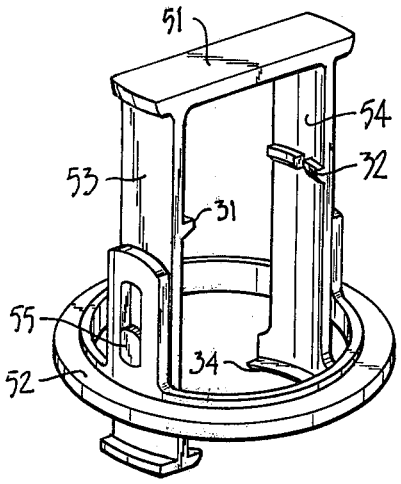
FIGS. 4A and 4B are perspective views of an alternate embodiment of the invention illustrating alternate operational positions.
Figure 4B:
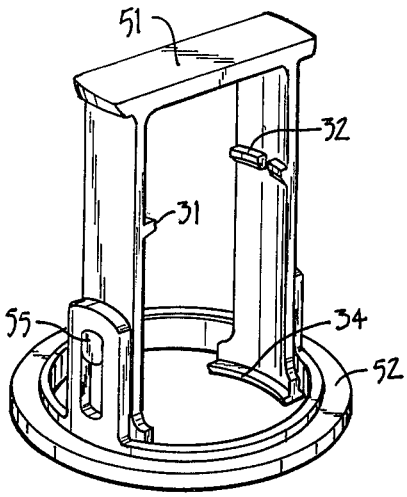

FIGS. 4A and 4B illustrate an alternate embodiment of the invention in which the flexing action of the leg portions 21, 22 is afforded by a flexible top portion 51, which eliminates the requirement for a pivot connection. This embodiment also incorporates a collar 52 which is slidably attached to the leg portions 53, 54 by means of molded lugs (only one 55 of which is visible in the perspective views afforded by FIGS. 4A and 4B).

Figure 5A:
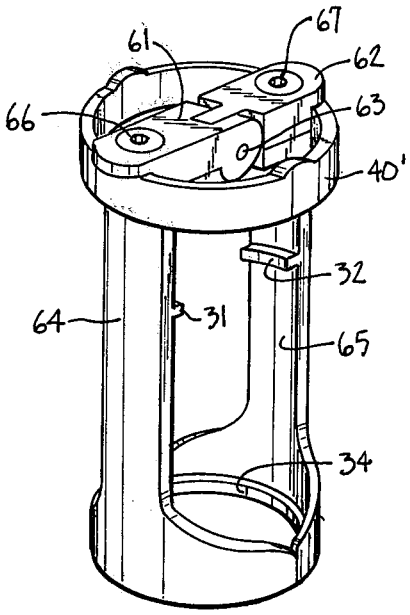
FIGS. 5A and 5B are perspective views of another embodiment of the invention similar to FIGS. 4A and 4B.
Figure 5B:
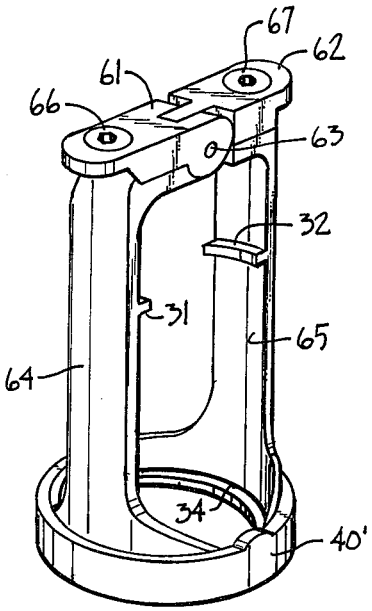

FIGS. 5A and 5B, which are perspective views similar to FIGS. 4A and 4B, illustrate an alternate embodiment of the invention in which the top member consists of two half portions 61, 62 pivotally connected by means of a pivot pin 63, and in which the individual leg portions 64, 65 comprise separate members attached to top half portions 61, 62, respectively by means of suitable fasteners such as Allen screws 66, 67.

Figure 6:
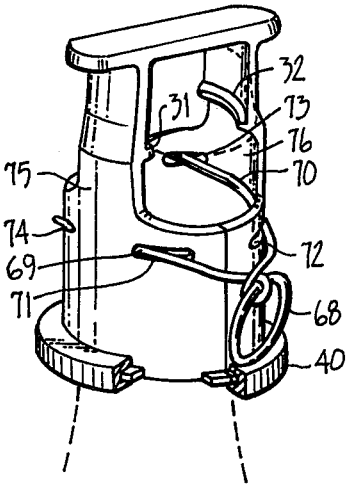
FIGS. 6 and 7 are perspective views partially broken away of two embodiments of the invention provided with the storage locking function.

FIG. 6 illustrates another embodiment of the invention in which a separate positive locking function is provided for the device. As seen in this figure, a locking wire having a ring pull portion 68 and a pair of arms 69, 70 is detachably engaged by means of a plurality of apertures 71–74 between the leg portions 75, 76 and the ridged neck 12 (not illustrated). During storage, arms 69, 70 prevent removal of the device by virtue of their mechanical engagement with the neck ridge of the bottle. When the user wishes to remove the stopper, the locking wire is first removed by grasping the ring pull 68 and withdrawing arms 69, 70 from apertures 71–74.

Figure 7:
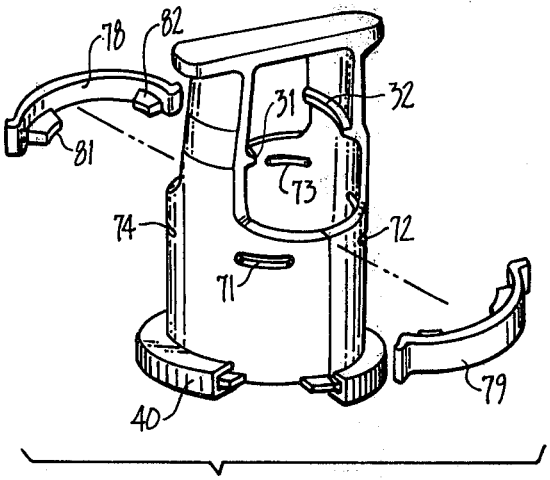
Figure 8D:
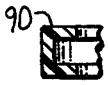
FIGS. 8A–8D illustrate another embodiment of the invention having the storage locking function.
Figure 8A:
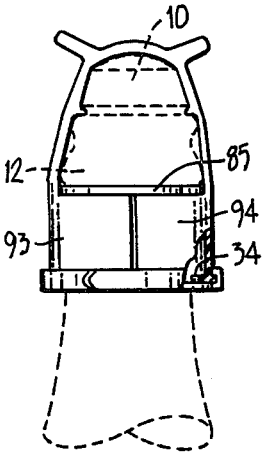
Figure 8B:
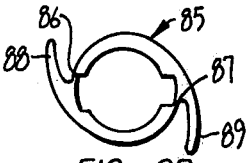
Figure 8C:
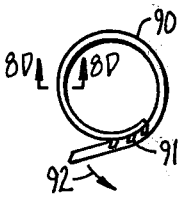

FIG. 7 illustrates another embodiment of the invention provided with a similar positive locking feature. In this embodiment, a pair of arcuate locking members 78, 79 are removably attached to the device by snap fitting lugs 81, 82 (and lugs 83, 84 for member 79) into apertures 73, 74 (and apertures 71, 72); respectively. The lugs 81–84 engage the under surface of neck ridge 12 to prevent movement of the device in the direction of stopper removal until members 78, 79 are withdrawn. In addition, members 78, 79 serve to lock the two leg portions 75, 76 together until removed.

FIGS. 8A–8D illustrate another embodiment of the invention incorporating the positive locking feature in a "throw away" version of the invention. As seen in these Figs., the positive locking member comprises a separate break away portion 85 best illustrated by the top plan view shown in FIG. 8B which comprises a generally annular molded member having break away joints 86, 87, and pull tab portions 88, 89. In addition, a removable collar 90 has a break away portion 91 providing a rupturable seal of sufficient strength to require a manual force applied in the direction of arrow 92 to separate the seal in portion 91. This seal may be provided by a suitable heat sealing step on a polyethylene material. Collar 90 has the u-shaped cross sectional configuration illustrated in FIG. 8D which captures the lower leg portions 93, 94 of the device. In use, the locking member 85 is first removed from its abutting position with the under surface of neck ridge 12 by grasping the pull tab portions 88, 89, and pulling outwardly to rupture the weakened joints 86, 87. After locking member 85 is discarded, the device may be manipulated to withdraw the stopper 10 until the lower inner ledge portions 33, 34 engage the neck ridge 12, after which collar 90 is released by rupturing the seal 91.

Figure 9A:
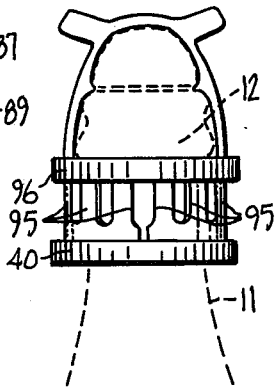
FIGS. 9A and 9B are views illustrating another embodiment of the invention having the storage locking function.
Figure 9B:
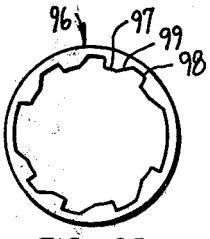

FIGS. 9A and 9B illustrate still another embodiment of the invention in which the positive locking function is afforded by a plurality of integrally molded spring fingers 95 which are maintained in abutting relationship with the under surface of neck ridge 12 by means of lock ring 96. As best illustrated by the top plan view shown in FIG. 9B, lock ring 96 has a serrated inner periphery having alternate lands 97 and grooves 98 joined by skewed wall portions 99, which facilitate the rotation of lock ring 96 so that the lands 97 press against the upper free ends of fingers 95 to maintain fingers 95 in the locked position. In use, locking ring 96 is rotated so that the grooves 98 are aligned with fingers 95 to free the fingers 95 from a constrained abutting position to a relaxed position in which the free ends of fingers 95 are positioned outwardly of neck ring 12, thereby permitting upward motion of the device.

Figure 10B:
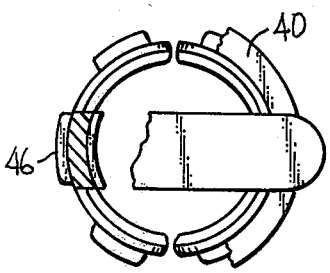
FIGS. 10A–10D illustrate another embodiment of the invention.
Figure 10D:
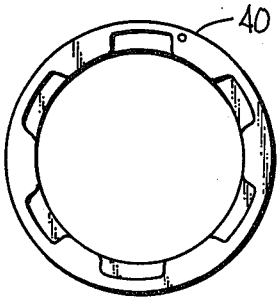
Figure 10A:
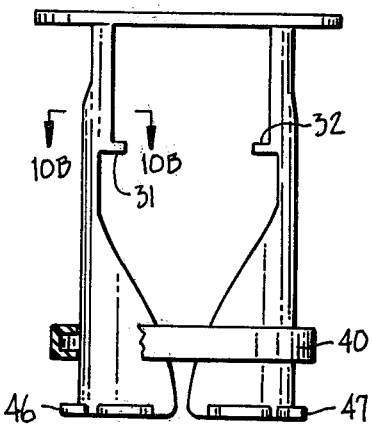
Figure 10C:
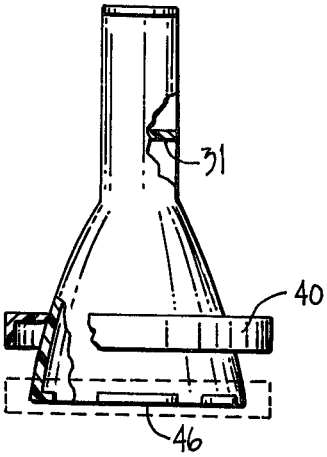

FIGS. 10A–10D illustrate another embodiment of the invention in which the major components are molded from a single piece of plastic, and in which the collar is essentially identical to collar 40 of the first embodiment described above. FIGS. 10A and 10C are side elevational views with the device rotated 90° about the longitudinal axis in the two different views. FIG. 10B is a top plan view with the portion denoted by the lines 10B in FIG. 10A partially broken away. FIG. 10D is a bottom plan view of collar 40.

Figure 11:
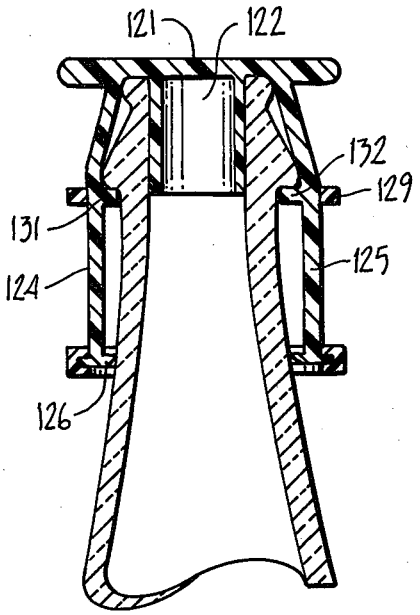
Figure 12:
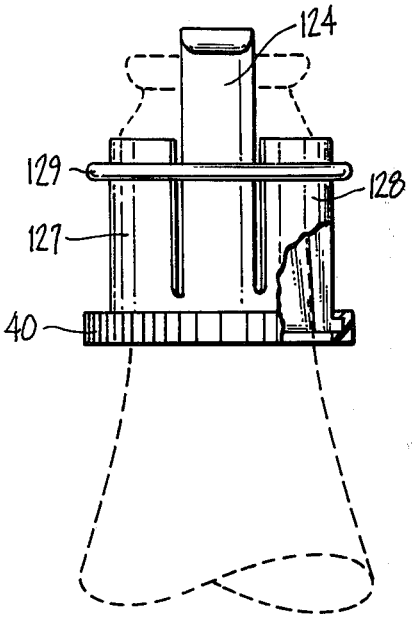
FIGS. 12 and 13 are views illustrating an alternate embodiment of the invention in which the stopper is incorporated into the device.

FIGS. 11 and 12 illustrate still another embodiment of the invention in which the stopper is incorporated into the opener device. As best seen in section in FIG. 11, in this embodiment a top member 121 has molded to the under surface thereof a stopper portion 122 which is generally cylindrical in shape. Top portion 121 blends into a pair of leg portions 124, 125 which extend downwardly and blend into a generally annular portion having lower inner ledge portion 126. A pair of circular segmental skirt portions 127, 128 provide additional contoured surfaces for a lock ring 129, which is normally received about the periphery of the device in the region of upper inner ledge portions 131, 132, which are formed in leg portions 124, 125. A collar 40 is provided for the bottom portion of the device, and collar 40 functions in the manner noted above.

Figure 13:
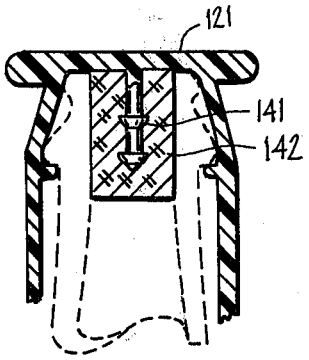

FIG. 13 illustrates in sectional view still another embodiment of the invention in which the under surface of a top member 121 is provided with a downwardly extending integral projection 141 which is forced into a cork stopper 142 at the bottling plant and which serves to remove the stopper 142 when the user manipulates the device in the direction of removal. The lower portion of the FIG. 14 embodiment may resemble any of the dual leg portion embodiments described above.

As will now be apparent, stopper removal devices fabricated in accordance with the teachings of the invention totally prevent spontaneous expulsion of a bottle stopper under the force of the gases within the bottle, and thus function as a safety device during storage of the bottle and removal of the stopper. The various embodiments of the invention may be most conveniently fabricated from relatively inexpensive molded plastic materials, either as a reusable item or as a throw away item incorporated as part of the bottle package at the bottling plant.

While the above provides a full and complete disclosure of the preferred embodiment of the invention, various modifications, alternate constructions and equivalents may be employed without departing from the true spirit and scope of the invention. For example, the required flexing of the leg portions may be provided by forming the upper portions thereof adjacent the connection to the top to a dimension sufficiently thin to permit the flexure but sufficiently strong to retain the stopper under force. In addition, the FIG. 9 embodiment may be provided with a lock ring 96 having a smooth inner circular wall in which case the fingers 95 must have a tapered thickness which increases in the upward direction. Therefore the above description and illustrations should not be construed as limiting the scope of the invention which is defined by the appended claims.

What is claimed is:

1. A device for removing a stopper from a container having a ridged neck, said device comprising:

a body having a top and opposed leg portions each joined at an upper end to said top, said leg portions having an upper and a lower inner ledge portion, said upper ledge portions being located longitudinally of said body at a distance below said top to enable the stopper to be clinched between said upper ledge portions and said top, said lower ledge portions being located longitudinally of said body at a distance below said top to provide a limit stop with the ridged container neck during removal of the stopper; and means for enabling said body to be arranged about the stopper and container neck.

2. The invention of claim 1 wherein said top comprises two half portions, and said enabling means comprises a pivot connection between said two half portions.

3. The invention of claim 1 wherein said enabling means comprises a flexure hinge formed in said top.

4. The invention of claim 1 wherein said enabling means comprises a flexure hinge formed in at least one of said leg portions adjacent said top.

5. The invention of claim 1 further including collar means movable longitudinally along the periphery of said body for restraining outward movement of said lower ledge portions during removal of the stopper.

6. The invention of claim 5 wherein said leg portions terminate at the lower end thereof in an outwardly extending tab portion, and wherein said collar means comprises an annular member having an inner groove engageable with each said tab portion and a lower flanged surface having a pair of relieved entrance portions for enabling each said tab portion to enter said groove when said annular member is rotated about the neck of the container.

7. The invention of claim 5 wherein said collar means comprises an annular member having a pair of upstanding leg portions with longitudinally extending apertures, and wherein said body leg portions are each provided with an externally mounted guide lug received in one of said apertures.

8. The invention of claim 1 further including locking means positioned intermediate said upper and lower ledge portions for preventing removal of the stopper until said locking means is released.

9. The invention of claim 8 wherein said locking means comprises a removable lock wire having a pair of legs received in apertures formed in said body leg portions in the region below the neck ridge of the container.

10. The invention of claim 8 wherein said locking means comprises at least one removable lock piece having an inner lug received in an aperture formed in one of said body leg portions in the region below the neck ridge of the container.

11. The invention of claim 8 wherein said locking means comprises a plurality of flexible fingers formed in said body and extending longitudinally thereof, said fingers terminating in a free end positioned adjacent the neck ridge of said container and outboard thereof when unconstrained, and a lock ring releasably secured to the free ends of said fingers for constraining said free ends in abutment with the neck ridge until said ring is released.

12. The invention of claim 11 wherein said lock ring has a serrated inner surface with alternate lands and grooves and skewed walls interconnecting the lands and grooves.

13. The invention of claim 11 wherein said lock ring has a smooth inner surface of substantially constant radius, and said flexible fingers have a tapered cross section with maximum thickness adjacent the free end.

14. The invention of claim 8 wherein said locking means comprises a releasable collar detachably secured to said body and having an inner ledge engaged with the neck ridge.

15. A safety stopper device for a container having a ridged neck, said device comprising:

a body having a top and opposed leg portions each joined at an upper end to said top, a stopper extending downwardly from said top for sealing the neck of the container when the device is installed, said leg portions having an upper and a lower inner ledge portion, said upper ledge portions being located longitudinally of said body at a distance below said top to normally engage the ridged container neck when said device is installed, said lower ledge portions being located longitudinally of said body at a distance below said top to provide a limit stop with the ridged container neck during removal of the stopper, a first locking ring received about the periphery of said body in the region of said upper ledge portions for preventing removal of the stopper until said first locking ring is released, and a second locking ring movable longitudinally along the periphery of said body for restraining outward movement of said lower ledge portions during removal of the stopper.

16. A device for removing a stopper from a container having a ridged neck, said device comprising:

a body having a top and opposed leg portions each joined at an upper end to said top, a projection extending downwardly from said top between said opposed leg portions for insertion centrally of the stopper and having means for providing a removing force to the stopper when the device is manipulated in the direction of stopper removal, said leg portions having an upper and a lower inner ledge portion, said upper ledge portions being located longitudinally of said body at a distance below said top to grip the under surface of the ridged neck, said lower edge portions being located longitudinally of said body at a distance below said top to provide a limit stop with the ridged container neck during removal of the stopper; and means for enabling said body to be arranged about the container neck.

17. The invention of claim 16 wherein said enabling means includes flexible portions of said body leg portions for permitting said upper ledge portions to bow outwardly away from the neck ridge of the container.

18. The invention of claim 16 further including locking means received about the periphery of said body and positioned adjacent said upper ledge portions for normally maintaining said upper ledge portions in contact with the neck ridge until said locking means is released.

19. The invention of claim 18 wherein said locking means comprises an annular member slidably received about the periphery of said body.

20. The invention of claim 16 further including collar means movable longitudinally along the periphery of said body for restraining outward movement of said lower ledge portions during removal of the stopper.

* * * * *